United States Patent [19]

Mackenzie et al.

[11] 4,092,241

[45] May 30, 1978

[54] ELECTROSTATIC SEPARATION OF PLASTIC FILM FROM SHREDDED WASTE

[75] Inventors: Harold B. Mackenzie, Wheaton, Ill.; Ingvar G. Anderson, Dunedin, Fla.

[73] Assignee: New Life Foundation, Wheaton, Ill.

[21] Appl. No.: 753,775

[22] Filed: Dec. 23, 1976

[51] Int. Cl.[2] ..... B03C 7/06

[52] U.S. Cl. ..... 209/127 A; 209/129; 209/3

[58] Field of Search ..... 209/11, 12, 45, 46, 209/127 R, 127 A, 127 C, 129, 3; 55/138, 131, 149, 12–14, 113

[56] References Cited

U.S. PATENT DOCUMENTS

| | | | |
|---|---|---|---|
| 1,575,165 | 3/1926 | Hopkinson | 209/129 X |
| 3,577,999 | 5/1971 | Pinkham | 209/3 |
| 3,599,788 | 8/1971 | Fyfe | 209/11 |
| 3,831,748 | 8/1974 | Berkowitz et al. | 209/12 |
| 3,833,117 | 9/1974 | Mackenzie et al. | 209/138 X |

FOREIGN PATENT DOCUMENTS

| | | | |
|---|---|---|---|
| 494,328 | 7/1950 | Belgium | 209/127 R |
| 1,154,052 | 9/1963 | Germany | 209/127 R |

*Primary Examiner*—Frank W. Lutter
*Assistant Examiner*—Ralph J. Hill
*Attorney, Agent, or Firm*—Hill, Gross, Simpson, Van Santen, Steadman, Chiara & Simpson

[57] ABSTRACT

Electrostatic separation of shredded plastic from processed shredded waste paper is effected in a shredded waste separation chamber having a vertically oriented passageway through which shredded waste paper and plastic descends. A vertical axis rotating plastic separator has an electrostatically charged and optionally heated surface area exposed in the passageway to the descending shredded waste for attracting the shredded plastic waste therefrom. Outside of the chamber the plastic waste is removed from the separator. Circulation of the descending waste material is promoted within the chamber to enhance contact of the plastic waste with the separator surface.

16 Claims, 3 Drawing Figures

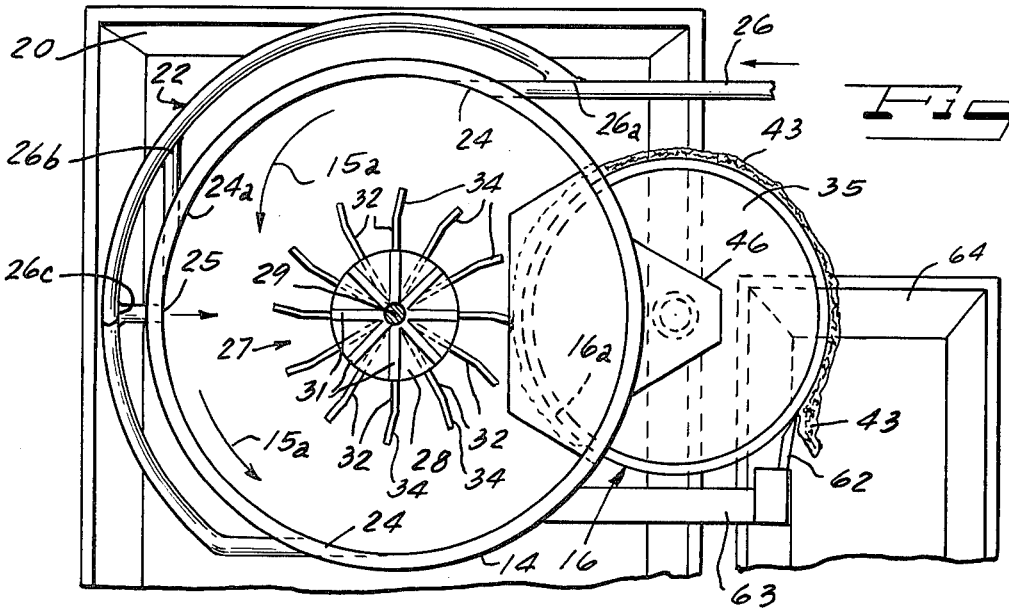
Fig. 2
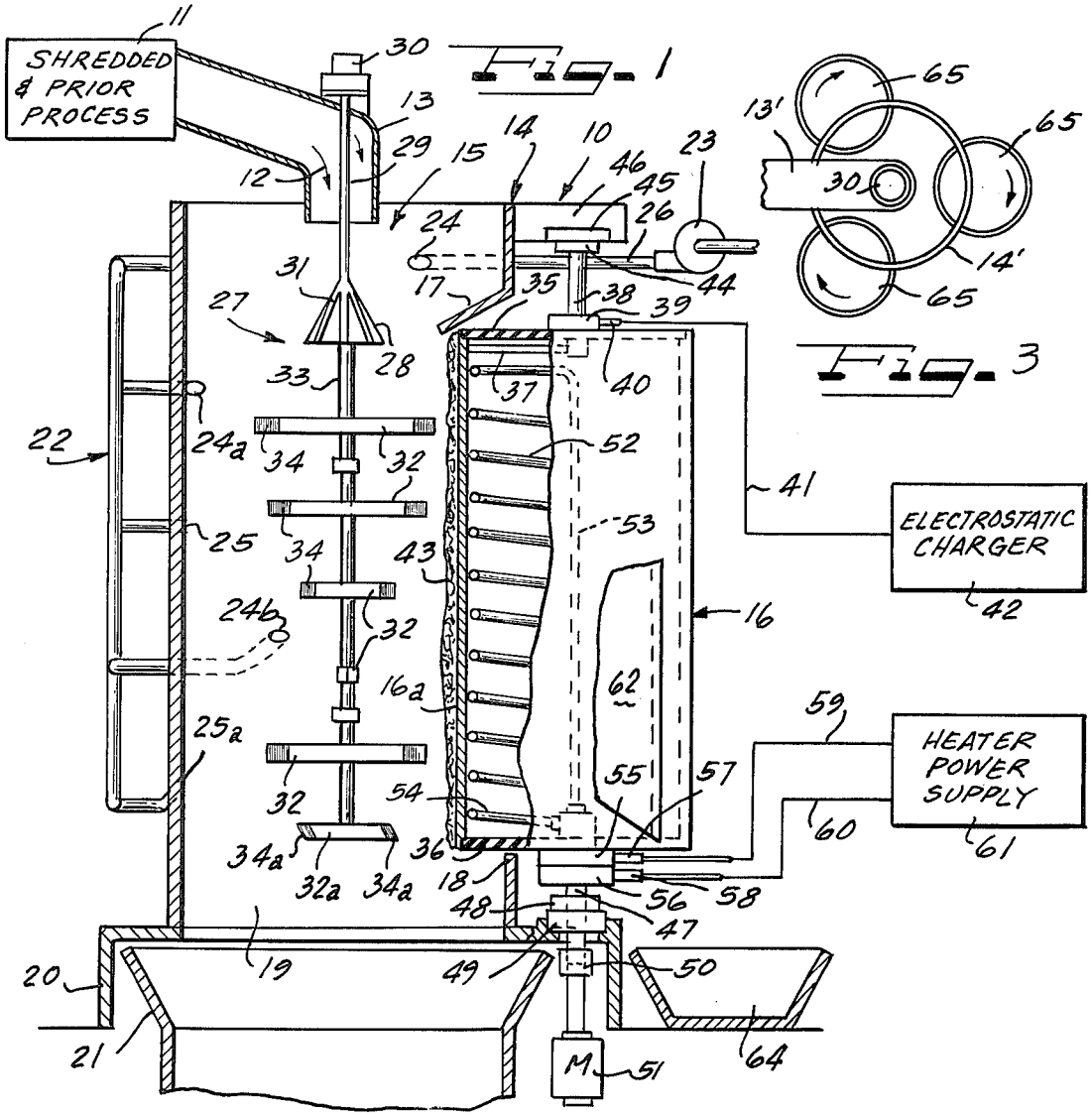
Fig. 1
Fig. 3

ELECTROSTATIC SEPARATION OF PLASTIC FILM FROM SHREDDED WASTE

BACKGROUND OF THE INVENTION

1. Field of the Invention

This invention relates to the separation of shredded plastic from processed shredded paper waste and more particularly to the use of electrostatic charging apparatus for such separation.

For conservation of natural resources, it is desirable to recycle paper derived from processed shredded waste. For this purpose the heavy materials commonly found in muniipal waste and including metal, glass, heavy plastics and the like are separated from the lighter fractions generally by air separation or classification. The separated shredded paper waste is useful as stock for papermaking. However, light plastic such as film plastic is a serious contaminant, causing plugging and fouling of the papermaking mahinery and resulting in imperfections in the final paper sheet. The use of film plastics is constantly increasing, so that the contamination of salvaged shredded waste paper is an increasingly serious problem where it is desired to recycle the processed shredded waste paper for papermaking. municipal 2. Description of the Prior Art The general concept of separating sheet plastic film from paper and other waste is disclosed in U.S. Pat. Nos. 3,643,797 and 3,831,748. In these patents plastic film is caused to adhere to brushes by electrostatic attraction. A comb with teeth then removes the plastic film from the brushes. In these patents, the electrostatic brushes are horizontally mounted.

U.S. Pat. No. 3,458,040 discloses the electrostatic separation of material by means of alternate longitudinal strips of conducting and non-conducting material.

U.S. Pat. Nos. 2,428,224 and 3,941,684 also discuss electrostatic separation concepts less pertinent to the present invention.

Although the general idea of separating plastic waste materials utilizing electrostatic charge is known in the art, none of the systems or methods suggested provide adequate operating efficiencies for practical large volume, low cost installations. Among the problems typically encountered are the inadequacy of prior art systems in attracting all of the shredded light plastic such as film. The prior art systems do not retain the shredded light plastic to the attracting means in a stable manner so that light shredded plastic is not removed during the separation process. Finally, the prior art systems cannot efficiently handle a large volume of shredded waste over short periods of time.

SUMMARY OF THE INVENTION

An object of the present invention is to provide for the electrostatic separation of shredded plastic from processed shredded waste in a new and improved manner which will overcome the disadvantages, drawbacks, inefficiencies, shortcomings and problems inherent in prior systems.

Another object of this invention is to provide a system for the separation of light shredded plastic material from shredded waste paper and which is faster and more efficient than prior art systems.

A further object of this invention is to provide a system to separate light shredded plastic materials from processed shredded waste paper as the shredded waste descends vertically through a separation chamber under the influence of gravity.

It is another objet of this invention to provide a separation system wherein light shredded plastic materials are efficiently electrostatically removed from processed shredded waste paper, to enable efficient use of the recovered paper for papermaking and use of the recovered plastic materials for fuel.

According to features of the invention, a waste separation system is provided which is adapted for separation of light shredded plastic materials from processed shredded waste paper, the system comprising a shredded waste separation chamber having a vertically oriented passageway through which the shredded waste descends, shredded waste feed means positioned to discharge into the top of the passageway, rotating plastic separating means dispose on a generally vertical axis and having a portion of its surface area exposed to said passageway through an aperture in said waste separation chamber, electrostatic charging means connected to the rotating means for imparting an electrostatic charge to the surface area of said rotating means to separate and attract light shredded plastic thereto from the shredded paper, and means for removing the shredded plastic from the surface area. The surface area of the rotating means may be heated for assisting in holding the shredded plastic waste thereto. Gentle swirling circulation of the descending shredded waste may be effected to increase exposure of the waste to the plastic removing surface area of the separator.

BRIEF DESCRIPTION OF THE DRAWINGS

FIG. 1 is a schematic side elevational sectional view illustrating a waste separation system according to the present invention;

FIG. 2 is a fragmentary top plan view of the waste separation system of FIG. 1; and FIG. 3 is a fragmentary top plan view of a modification.

DESCRIPTION OF PREFERRED EMBODIMENTS

A waste separation system 10 (FIG. 1) embodying features of the invention is adapted for efficiently separating shredded-light plastic from processed shredded waste paper after processing has been completed to the extent of classifying the light paper fraction derived from municipal waste which has been shredded and processed in suitable apparatus diagrammatically represented by flow diagram box 11. As thus processed, the shredded waste paper has shredded light plastic material mixed with it. According to the present invention, the shredded waste, identified at 12 is delivered by feed means such as a downwardly opening duct 13 into the top of a shredded waste separation chamber which may be in the form of a tower 14 providing a vertically oriented passageway 15 through which the shredded waste descends from the discharge end of the delivery duct 13.

For separating light shredded plastic from the shredded waste paper descending through the chamber 15, rotary plastic separating means desirably in the form of a cylindrical metal frum 16 disposed on a generally vertical axis has a substantial portion **16*a* of its surface area exposed to the passageway 15 under an inwardly directed eave 17 at the top of a cut-out or aperture 18 of a size, in this instance, to permit about ⅓ of the preferably smooth cylindrical perimeter 16*a* of the drum 16 to project into the passageway 15. As will be observed, the drum 16 is preferably of the maximum length relative to the length of the passageway 15** practicable under the circumstances.

At its lower end, the passageway 15 is open to permit separated shredded waste paper to drop from the chamber through a base 20 supporting the chamber tower 14. Below the opening 19 the separated shredded paper is collected in a receiver 21 of any preferred form and which may be an outlet chute leading to take-away converyor means or other means for transporting or storing the recovered shredded waste paper for use.

In the chamber passageway 15 the descending shredded waste paper and plastic mixed with it are caused to move with a generally swirling motion so as to assure exposure of all of the material to the separator surface **16*a* at least once and preferably several times during descent through the passageway 15. To this end, swirl-inducing means are provided which will not only slow down the descent of the shredded material but will also cause the shredded material to follow a generally spiral path of travel as generally indicated by the directional arrows 15*a* in FIG. 2. This will reasonably assure that all of the waste material will sweep into contact with the exposed perimeter 16*a*** of the separator drum. Although such means may be entirely pneumatic, or entirely mechanical, a combination of pneumatic and mechanical means provide for exceptional efficiency.

Pneumatic separation promoting means for the shredded material desirably comprise an air duct system 22 supplied with air from a suitable source such as an air pump or blower 23. For imparting swirling motion to the descending shredded material within the chamber passageway 15, the air is introduced at least in part generally tangentially through the wall of the tower 14 at properly located points preferably in a generally staggered manner and at progressively lower elevations starting near the top of the chamber passageway 15. For example, one or more air directing ports 24 may enter the chamber adjacent the upper end of the tower 14 to start the swirling motion of the shredded waste material dropping from the inlet 13. Then at a lower level generally aligned with the upper end portion of the separator drum 16 one or more additional tangential ports **24*a* introduce booster swirl inducing air. Aligned with generally the lower portion of the drum 16 one or more generally tangential inlet ports 24*b* introduced follow-up booster swirl inducing air. In addition to a swirling bias, the one or more inlet ports 24*b* are desirably directed with a generally upward bias so as to impart a generally upward lifting component of thrust in addition to the swirling component of thrust imparted by the air issuing from these ports and thereby tending to slow the descent of the shredded material. In order to avoid coring or cylindrical stratification of the shredded material in swirling motion within the chamber passageway 15, a series of vertically spaced air inlet ports are provided generally diametrically opposite the separator drum surface 16*a* whereby to effect a circulation bias of the shredded material toward the separator drum. Air ports for this generally diametric circulation bias comprise, for example, a diametrically directed upper port 25 and a generally diametrically directed lower port 25*a*. In addition to the diametrically biasing air thrust imparted by the lower port 25*a*, it also desirably projects the air therefrom generally upwardly, thereby supplementing the port or ports 24*b* in slowing the descent of the shredded material. Because the pneumatic system 22 is a generally low pressure system, all of the air can be supplied from one source through a common duct 26, from which various branch ducts are tapped off, such as exemplified at 26*a*, 26*b* and 26*c***.

Mechanical means 27 for promoting circulation and contact of the descending shredded material with respect to the separator drum surface area **16*a* comprise a distributor cone 28 which may be of substantially the same maximum diameter as the delivery inlet from the duct 13 and the apex of the cone spaced adjacently below the delivery inlet. Means for rotatably supporting the cone 28 comprise a rotary shaft 29 extending downwardly through the duct 13 and driven by suitable means such as a prime mover 30 which may comprise an electrical motor operating through speed reducing means so that the cone 28 will rotate at a reasonably slow speed which will be fast enough to cause the fairly flocculent descending shredded material 12 to distribute generally throughout the passageway 15 without undue turbulence. Distribution capability of the cone 28 is desirably improved by means of longitudinally extending distributor ribs or vanes 31 located on the distributor surface of the cone and radiating generally from adjacent to its apex. Below the cone 28, additional distributor and circulating promoting means are provided in the form of a vertically spaced series of impeller paddles 32 which are desirably circumferentially staggered along a downward extension 33 of the shaft 29. Each of the paddles 32 may extend generally radially from the shaft section 33 and may be provided at its outer end with a vane section 34 angled generally away from the direction of rotary movement of the paddles, as indicated in FIG. 2. Thereby in the rotation of the paddles 32, swirling circulation of the air and of the descending shredded material and plastic separating contact of the shredded material with the drum surface area 16*a* are promoted. For slowing down descent of the shredded material in its descent through the passageway 15, one or more and at least the lowest of the paddles, identified at 32*a* and which may be generally aligned with the lower end portion of the drum 16, has its outer end terminal vanes 34*a* tilted to face generally upwardly in the direction of rotary movement of the vanes so as to have an upward biasing effect on the air circulation promoted thereby. Although the mechanical circulation promoting means 27 may be employed alternatively to the pneumatic circulation promoting means 22**, the two means functioning together provide utmost efficiency in the shredded plastic separation system.

At least the perimeter of the separator drum 16 is of a material which can be electrostatically charged. A metal perimeter surface is satisfactory for this purpose. At its upper end, the drum 16 has an insulated end wall 35. At its lower end, the drum 16 has a lower insulated end wall 36. For electrostatically charging the drum perimeter, means such as a connecting bus bar or wire 37 provides an electrical connection between the perimeter surface and a shaft 38 at the upper end wall 35. Means such as a slip ring 39 on the shaft 38 is contacted by a suitable brush 40 connected as by means of an electrical lead 41 with an electrostatic charger 42. This charger produces an electrostatic charge on the perimeter of the drum 16 which attracts the shredded plastic mixed in with the shredded paper and causes the separated plastic to adhere to the perimeter areas **16*a* in a layer 43. The shaft 38 may be insulated above the slip ring 39 or, if the shaft is of a conducting material, it may be mounted at its upper end by means of a bearing 44 in an insulated mounting 45 carried by means such as a supporting arm 46**.

At its lower end, the drum 16 is rotatably supported on an axle 47 mounted in a thrust bearing 48 cooperating with a complementary thrust bearing 49 mounted on the base 20. For driving the drum 16 through the shaft 47, this shaft may be connected by means of a coupling 50 with a prime mover such as a drive motor 51 which will drive the drum 16 at a reasonably slow rotary speed coordinated with the swirling speed of the shredded material in the passageway 15 and the magnitude of electrostatic charge on the drum perimeter to attain maximum electrostatic shredded plastic separation efficiency.

At least under some circumstances efficiency in shredded plastic separation may be increased by heating the perimeter of the separator drum 16 sufficiently to at least partially melt the plastic particles electrostatically attracted to the drum perimeter to avoid falling away of the particles. Such heating of the drum should be short of the char point for the shredded waste paper from which the shredded plastic has been separated. Although steam heating of the drum 16 may be effected, the heating may conveniently be by means of a helically wound heater element 52 which may be spirally wound along the interior of the wall of the drum 16. End leads 53 and 54 from the respective opposite ends of the heater coil 52 connect with slip rings 55 and 56, respectively on the shaft 47. Brushes 57 and 58, respectively, effect a power coupling through respective leads or cables 59 and 60 with a power supply 61. It will be appreciated, of course, that a suitable insulated relationship will be provided wherein the shaft 47 may be insulated below the slip rings 55 and 56 or, if the shaft is of a conducting material, the mounting for the bearing 49 and the coupler 50 may be suitably insulated or of insulating material.

At least where the heater 52 or similar heating means are employed, means are provided for removing the layer 43 of recovered waste plastic. In one desirable form, the plastic removal means may comprise a scraper blade 62 suitably located to scrape the layer 43 from the perimeter of the drum 16 at a convenient location outside of the tower 14. For supporting the blade 62 operatively a suitable blade-supporting mount 63 is provided and may be carried by the tower 14 or the base 20. Plastic material removed from the drum 16 may be received in a bin 64 or if preferred on a take-away conveyor position below the lower end of the scraper blade 62.

For large scale separation, the modified arrangement of FIG. 3 may be employed. Instead of a single rotating separator drum, the tower 14' has a plurality of separator drums 65 projecting peripherally partially into the tower 14' for the same purpose and to the same effect as the drum 16. The separator drums 65 are desirably located at equidistantly spaced circumferential positions with respect to the separating tower 14' to which the shredded waste paper and plastic material is delivered by means of a duct 13' similarly as described in connection with the tower 14.

From the foregoing it will be apparent that the present invention provides a new and improved system for separating processed shredded waste paper and plastic materials, resulting in recovering shredded waste paper substantially free from plastic so that the recovered waste paper may be utilized to utmost advantage in producing recycled paper free from the disadvantages heretofore encountered due to plastic contamination of the recycled paper stock. In addition, the recovered plastic separated from the shredded material may be effectively utilized for fuel. As is well-known, the plastic material has a very high Btu value as fuel.

It will be understood that variations and modifications may be effected without departing from the spirit and scope of the novel concepts of this invention.

We claim as our invention:

1. A waste separation system adapted for separation of processed shredded waste comprising light shredded plastic materials and shredded waste paper, the system comprising:

(a) means having a shredded waste separation chamber and providing a generally vertically oriented passageway through which the shredded waste descends;

(b) shredded waste feed means positioned to deliver into the top of the passageway;

(c) rotating plastic separating means disposed on a generally vertical axis and having a surface area portion exposed to said passageway through an aperture in said waste separation chamber;

(d) electrostatic charging means connected to said rotating means for imparting an electrostatic charge to said surface area portion of said rotating plastic separating means to separate and attract to said area and retain shredded plastic waste from the shredded waste paper;

(e) means for removing the separated plastic waste from said surface area portion;

(f) means located within said passageway adjacently below said shredded waste feed means and operating to effect spreading of the descending shredded waste within said chamber passageway;

(g) means below said spreading means for effecting swirling circulation movement of the descending shredded waste to enhance contact of the shredded waste with said surface area portion;

wherein said spreader means comprise a conical spreader having spreader promoting means thereon, and said swirling movement effecting means comprise a vertical series of paddles, a shaft supporting said spreader and said paddles, and means for rotatably driving the shaft to effect rotation of the spreader and the paddles.

2. The system of claim 1, in which heating means are provided for heating said surface area portion of the rotating means for assisting in holding the electrostatically attracted shredded plastic waste thereon.

3. The system of claim 2. in which said heating means are electrically operated to heat the rotating means surface area portion to just under the char point for shredded paper waste.

4. The system of claim 1, in which said means for removing comprises a scraper blade operating against said surface area portion of the rotating plastic separating means.

5. The system of claim 1, in which said shredded waste separation chamber means comprises a cylindrical tower having a lower end outlet for the shredded waste paper from which the shredded plastic material has been separated.

6. The system of claim 1, in which said rotating plastic separating means are cylindrical and having the axis of rotation parallel to a central, longitudinal axis of the separation chamber passageway.

7. The system according to claim 1, wherein said vertical series of paddles, also have means for effecting an upward bias in the circulation movement of the shredded waste in the lower portion of said passageway.

8. A system according to claim 1, wherein said rotating separating means comprise a plurality of rotary drum members each of which has a surface area portion exposed to the chamber passageway and adapted to separate the shredded plastic from the shredded waste paper.

9. A waste separation system adapted for separation of shredded plastic material from processed shredded waste paper comprising:

(a) means having a waste separation chamber providing a substantially vertically oriented passageway through which the shredded waste paper and plastic descends;

(b) processed shredded waste delivery means positioned to deliver into the top end of said passageway;

(c) a rotating separator having a surface area portion exposed to said passageway;

(d) means for effecting circulation of the shredded waste paper and plastic in said passageway toward said surface area portion;

(e) means for heating said surface area portion of the rotating means for holding the shredded plastic material to the surface area portion and thereby separating the shredded plastic waste from the shredded waste paper;

(f) means for removing the plastic waste from said surface area outside of said passageway;

wherein said means for effecting circulation comprise a combination of induced air and mechanical circulation promoting devices.

10. A system according to claim 9, including means for electrostatically charging said surface area portion whereby to enhance movement of the shredded plastic material onto said surface area portion.

11. A method for separating shredded plastic material from processed shredded waste paper, comprising:

(a) depositing processed shredded waste paper having shredded plastic mixed therewith into the upper end of a waste separation tower passageway;

(b) continuously swirling a shower of the descending shredded waste in said passageway;

(c) rotating a separator on a substantially vertical axis;

(d) exposing a surface area portion of the separator in exposed relation to the shredded waste swirling in said passageway, effecting attachment of the shredded plastic to said surface area and thereby separating the plastic from the shredded waste paper;

(e) cleaning the plastic from the surface area portion separately from removal of the separated shredded waste paper from said passageway; and (f) effecting spreading of the shredded waste paper as it is deposited in the top of said passage, and subjecting the descending shredded waste paper and plastic to a combination of biasing air and mechanical stirring and thereby promoting separating exposure of the shredded plastic to said surface area portion.

12. A method according to claim 11, comprising effecting attachment by electrostatically charging said surface area portion for attracting the shredded plastic to said surface area portion for separating the plastic from the shredded waste paper.

13. A method acording to claim 11, comprising effecting attachment by heating said surface area portion to a temperature sufficient to hold the shredded plastic thereto by partial melting of the shredded plastic, and lower than the char point of the shredded waste paper.

14. A method according to claim 11, comprising effecting attachment by a combination of electrostatic charging and heating of said surface area portion whereby to hold thereon the shredded plastic separated from the shredded waste paper.

15. A method according to claim 11, wherein said effecting attachment comprises at least partially melting the separated shredded plastic to facilitate holding of the separated shredded plastic on said surface area portion.

16. A method according to claim 11, wherein said separator comprises a drum having said surface area portion thereon, and effecting the removal of the plastic from the surface area portion by applying a scraper blade to said surface area portion in the rotation of the separator.

* * * * *

UNITED STATES PATENT AND TRADEMARK OFFICE

CERTIFICATE OF CORRECTION

PATENT NO. : 4,092,241

DATED : May 30, 1978

INVENTOR(S) : Harold B. Mackenzie, Ingvar G. Anderson

It is certified that error appears in the above-identified patent and that said Letters Patent are hereby corrected as shown below:

Column 1, line 14 for "muniipal" read --municipal--.
Column 1, line 20 for "mahinery" read --machinery--.
Column 1, lines 25 and 26, delete "municipal".

Column 2, line 3, for "objet" read --object--.
Column 2, line 63 for "frum" read --drum--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*